US007332867B2

(12) United States Patent
Cho

(10) Patent No.: US 7,332,867 B2
(45) Date of Patent: Feb. 19, 2008

(54) APPARATUS AND METHOD FOR DRIVING LAMP OF LIQUID CRYSTAL DISPLAY DEVICE

(75) Inventor: Guang Sup Cho, Seoul (KR)

(73) Assignee: LG.Philips LCD. Co., Ltd, Seoul (KR)

( * ) Notice: Subject to any disclaimer, the term of this patent is extended or adjusted under 35 U.S.C. 154(b) by 253 days.

(21) Appl. No.: 11/141,697

(22) Filed: May 31, 2005

(65) Prior Publication Data

US 2005/0280374 A1 Dec. 22, 2005

(30) Foreign Application Priority Data

May 31, 2004 (KR) ..... 10-2004-0039137

(51) Int. Cl.
*H05B 37/02* (2006.01)

(52) U.S. Cl. ..... 315/209 R; 315/291; 315/224

(58) Field of Classification Search ..... 315/224, 315/209 R, 291, 307, 225, 276; 345/102
See application file for complete search history.

(56) References Cited

U.S. PATENT DOCUMENTS 5,952,791 A * 9/1999 Watanabe et al. ..... 315/225
6,281,636 B1 * 8/2001 Okutsu et al. ..... 315/209 R
6,680,583 B2 * 1/2004 Noda et al. ..... 315/224
6,870,330 B2 * 3/2005 Choi ..... 315/307
7,119,495 B2 * 10/2006 Jang ..... 315/244
7,253,565 B2 * 8/2007 Kang et al. ..... 315/276
2004/0100438 A1 * 5/2004 Lee et al. ..... 345/102

* cited by examiner

*Primary Examiner*—Douglas W. Owens
*Assistant Examiner*—Jimmy Vu
(74) *Attorney, Agent, or Firm*—Brinks Hofer Gilson & Lione

(57) ABSTRACT

A lamp driving apparatus of a liquid crystal display device and method of driving lamps in a liquid crystal display are described. The lamp driving apparatus includes lamps that irradiate a liquid crystal display panel with light. An inverter receives a DC voltage from an exterior voltage source, converts the DC voltage into an AC signal and supplies the converted AC signal to the lamps. A feedback circuit is arranged between the inverter and the lamps. The feedback circuit detects currents from the lamps. An inspecting part is disposed between the feedback circuit and the lamps. The inspecting part contains light emitting devices to determine if each of the lamps is operating normally or has an abnormality.

18 Claims, 8 Drawing Sheets

APPARATUS AND METHOD FOR DRIVING LAMP OF LIQUID CRYSTAL DISPLAY DEVICE

This application claims the benefit of Korean Patent Application No. P2004-39137 filed in Korea on May 31, 2004, which is hereby incorporated by reference.

FIELD OF THE INVENTION

The present invention relates to an apparatus and method for driving a lamp of liquid crystal display device, and more particularly, to an apparatus for driving a lamp of liquid crystal display device that is capable of protecting a lamp by intercepting a power supply flowing in a lamp when one lamp among a plurality of lamps is abnormal.

DESCRIPTION OF THE RELATED ART

In general, the number of applications using liquid crystal displays (hereinafter, LCD) have been increasing due to the lightness, thinness, and low power consumption of the LCD. In accordance with such a trend, the LCD is used in an office automation device, an audio/video device and the like. The LCD adjusts transmittance of light in accordance with an image signal applied to a matrix of a plurality of control switches to thereby display desired pictures in a screen.

Since the LCD is not a spontaneous light-emitting display device, the LCD device uses a back light unit as a light source. There are two types of back light units for the LCD, i.e., a direct-below-type and a light guide plate-type. In the direct-below-type, several lamps are arranged in the plane. A diffusion panel is installed between the lamp and the liquid crystal display panel to fixedly keep the distance between the liquid crystal display panel and the lamp. There are two types of direct-below-type units, i.e., a cold cathode fluorescent lamp (CCFL) and an external electrode fluorescent lamp (EEFL). In the CCFL type, an electrode is applied to both ends of glass tube of lamp to apply power supply. In the EEFL type, a power supply is applied to an electrode part in which a metal material is applied to both ends of glass tube of lamp.

Referring to FIGS. 1-3, the LCD adopting a related art direct-below-type backlight includes a liquid crystal display panel 2 to display a picture, a direct-below-type backlight assembly to irradiate uniform light onto the liquid crystal display panel 2, and a lamp driver 60 for driving the backlight assembly.

In the liquid crystal display panel 2, liquid crystal cells are arranged between an upper substrate and a lower substrate to form an active matrix type display. A common electrode and pixel electrodes that apply an electric field to each of the liquid crystal cells are also provided. Each of the pixel electrodes is connected to a thin film transistor that is used as a switch device. The pixel electrode drives the liquid crystal cell along with the common electrode in accordance with a data signal supplied through the thin film transistor, thereby displaying a picture corresponding to a video signal.

The direct-below-type backlight assembly includes: a lamp housing 34, a reflection sheet 14 stacked on a front surface of the lamp housing 34, a plurality of lamps 36 located at an upper part of the reflection sheet 14; a diffusion plate 12; and optical sheets 10.

The lamp housing 34 prevents the light leakage of visible radiation emitted from each of the lamps 36 and reflects the visible radiation, progressing to the side surface and the rear surface of the lamps 36, to the front surface, i.e., toward the diffusion plate 12, thereby improving the efficiency of the light generated at the lamps 36.

The reflection sheet 14 is arranged between the lamps 36 and the upper surface of the lamp housing 34 to reflect the light generated from the lamps 36 so as to irradiate it to a liquid crystal display panel 2 direction, thereby improving the efficiency of light.

Each of the lamps 36 includes a glass tube, an inert gas in the inside of the glass tube, and a cathode and an anode formed of metal metallic covering both ends of the glass tube. The lamps 36 are arranged in parallel on the lamp housing 34.

The diffusion plate 12 enables the light emitted from the lamps 36 to progress toward the liquid crystal display panel 2 and to be incident in a wide range of angles. The diffusion plate 12 contains a light diffusion member coated on both sides of a transparent resin film.

The optical sheets 10 narrow the viewing angle of the light coming out of the diffusion plate 12, thus improving the front brightness of the liquid crystal display device and reducing the power consumption.

The lamp driver 60, as shown in FIG. 3, includes an inverter 46 to receive DC voltage from an external voltage source and to convert it into an AC signal; a transformer 48 boosting the AC signal generated from the inverter 46 to apply the boosted AC signal to the lamp 36; a feedback circuit 42 to detect a current supplied from the inverter 46 to the lamp 36; and a controller 44 to control the inverter 46 in accordance with a feedback signal generated from the feedback circuit 42.

Each of the lamps 36 includes a glass tube, an inert gas in the inside of the glass tube, and a cathode and an anode installed at both ends of the glass tube. The inside of the glass tube is charged with the inert gas, and the phosphorus is spread over the inner wall of the glass tube. Further, the cathode and the anode of each lamp 36 are integrated in the same polarity.

The inverters 46 receive a DC voltage from an external voltage source and use a switch device included in the inverter circuit 46 to thereby convert the DC source into an AC signal.

Each of the transformers 48 is induced to an AC voltage generated to a primary winding 51 by switching of the switch device included in the inverter 46, to include a secondary winding 53 generating an AC high voltage and an auxiliary winding 52 arranged between the primary winding 51 and the secondary winding 53. These transformers 48 boost the AC signal generated from the inverter 46 to supply it to the lamps 36.

The feedback circuit 42 detects the AC high voltage, generated from the inverter 46 to be supplied to the lamps 36, to generate a feedback voltage. If the feedback circuit 42 is instead located at the output terminal of the lamp 36, the feedback circuit 42 detects the output value outputted from the lamp 36.

The controller 44 receives the feedback voltage F/B generated from the feedback circuit 46 to control the switch device included in the inverter circuit 46. More specifically, if the feedback voltage F/B is higher than a predetermined reference voltage, then the controller 44 makes the switch device transmit a voltage lower than the reference voltage. In other words, a voltage amount is lowered, so that a current flowing in the lamp 36 is lowered. On the other hand, if the feedback voltage F/B is lower than the predetermined reference, then the controller 44 makes the switch device transmit a voltage higher than the reference voltage. In other words, a voltage amount becomes higher, so that a current flowing in the lamp 36 becomes higher.

The liquid crystal display device having the above compositions has a problem in that it is difficult to control the lamps 36 because the lamps 36 are integrated to apply power thereto. In other words, if one or more of the lamps 36 are turned-off due to a bad lamp or a breakage of more than one of the lamps 36, then the lamps that are not turned-off become brighter in order to maintain a regular brightness. Accordingly, since a load on each of the lamps becomes larger, there is a problem that a life span of these lamps becomes reduced. Thus, a system for inspecting bad lamps and the breakage of a lamp is desirable.

SUMMARY OF THE INVENTION

By way of introduction only, in one aspect, a lamp driving apparatus of a display device comprises a plurality of lamps to irradiate light to a display panel. An inverter receives a DC voltage from an exterior voltage source to convert the DC voltage into an AC signal and to supply the converted AC signal to the lamps. A feedback circuit is arranged between the inverter and the lamps to detect a current outputted from the lamps. An inspecting part is disposed between the feedback circuit and the lamps. The inspecting part comprises a light emitting device to determine if one of the lamps has an abnormality.

In another aspect, the lamp driving apparatus comprises a plurality of lamps that irradiates a display panel with light. A feedback circuit adjusts a voltage supplied to the lamps dependent on a feedback signal from the lamps. A determination circuit comprises an optical transmitter-receiver pair for each of the lamps. Each optical transmitter-receiver pair reacts differently when the associated lamp has an abnormality than when the associated lamp is operating normally and adjusts the feedback signal dependent on output signals from the optical transmitter-receiver pairs.

In another aspect, a method of driving a plurality of lamps of a display device comprises supplying a current from each of the lamps to a different optical transmitter; altering transmission from the optical transmitters dependent on the current from the lamps; and adjusting a voltage supplied to the lamps dependent on a signal from each of the optical transmitters. The current from each of the lamps is dependent on whether the lamp has an abnormality or whether the lamp is operating normally.

BRIEF DESCRIPTION OF THE DRAWINGS

The invention will be apparent from the following detailed description of the embodiments of the present invention with reference to the accompanying drawings, in which.

DETAILED DESCRIPTION OF THE PREFERRED EMBODIMENT

Reference will now be made in detail to the preferred embodiments of the present invention, examples of which are illustrated in the accompanying drawings.

Hereinafter, the preferred embodiments of the present invention will be described in detail with reference to FIGS. 4 to 8.

Figure 1:
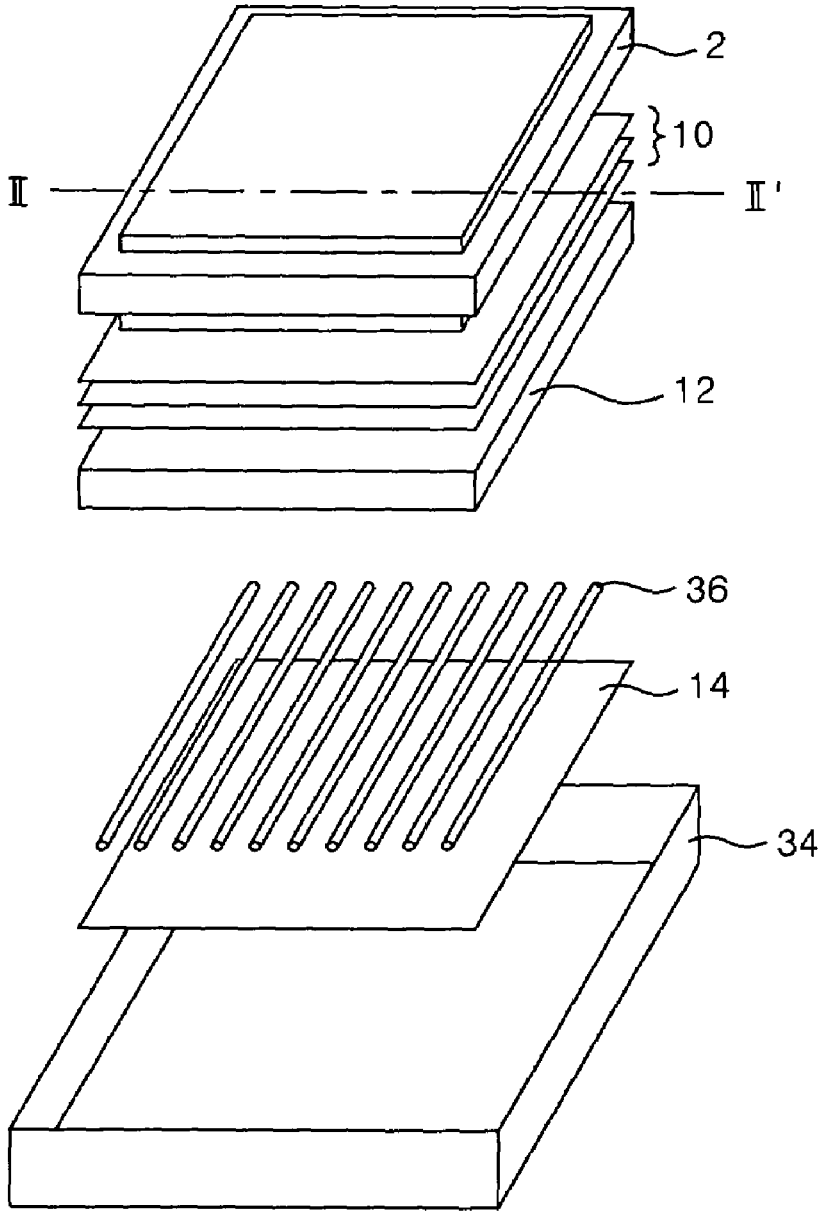
FIG. 1 RELATED ART
FIG. 1 is a perspective view illustrating a related art direct-below-type liquid crystal display device.
Figure 2:
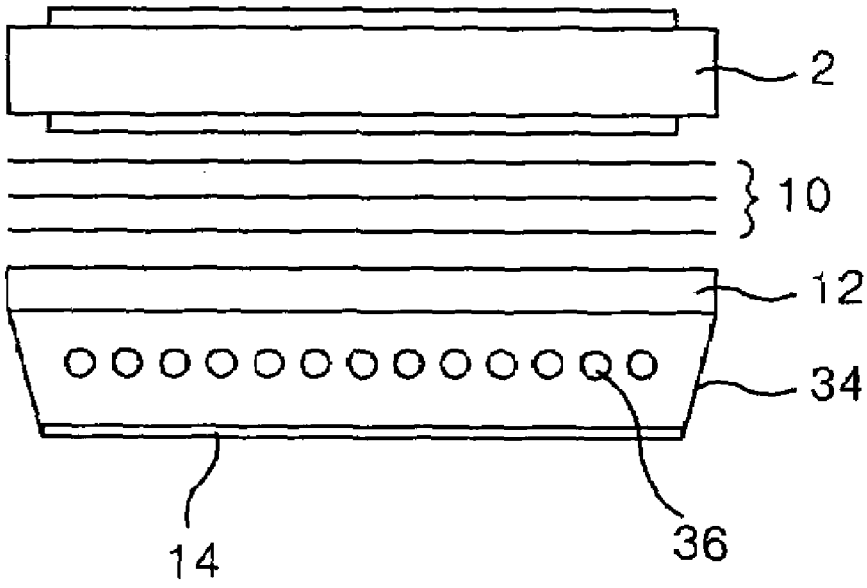
FIG.2 RELATED ART
FIG. 2 is a sectional view illustrating the liquid crystal display device taken along the line II-II' in FIG. 1.
Figure 3:
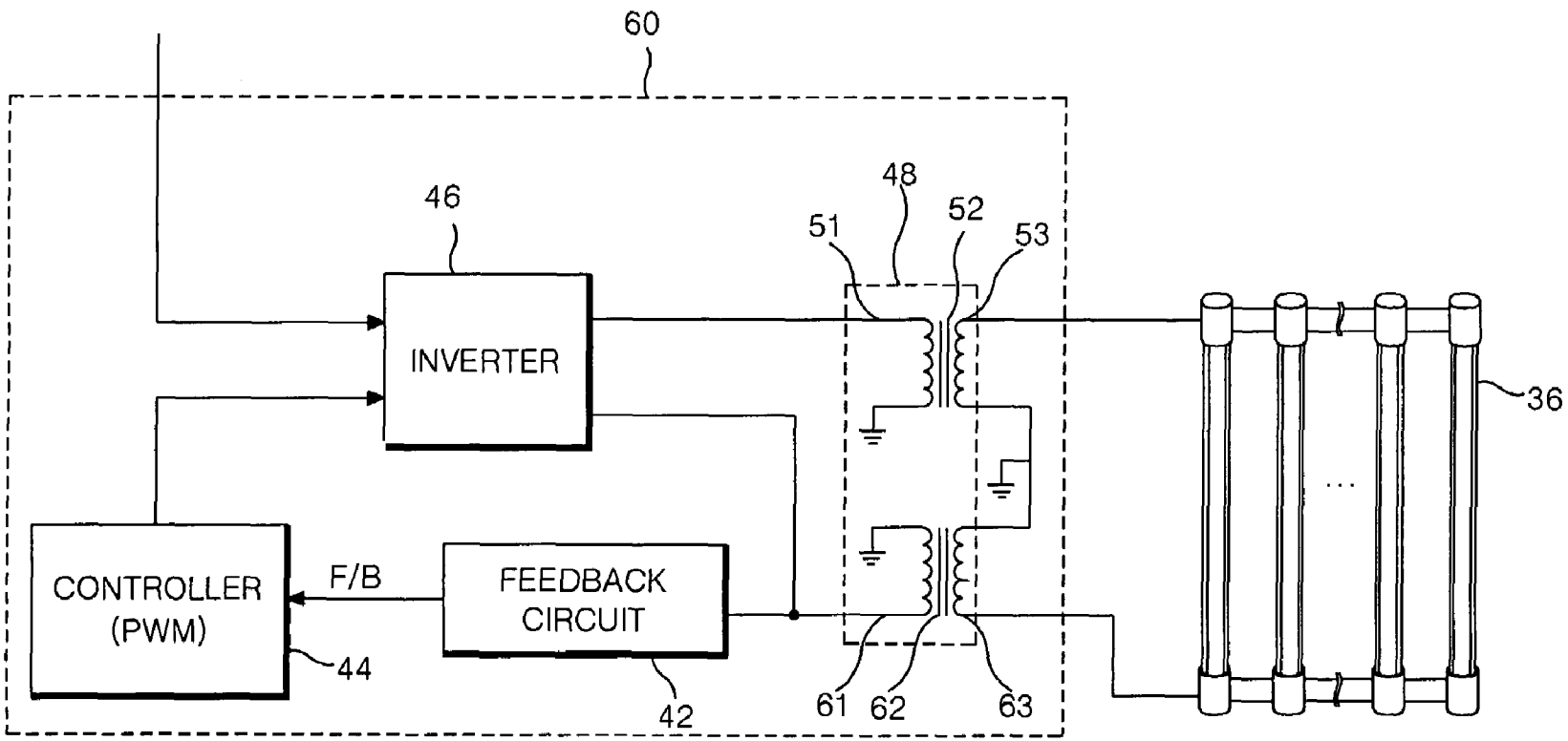
FIG. 3 RELATED ART
FIG. 3 is a block diagram illustrating a lamp driver of the related art liquid crystal display device.
Figure 4:
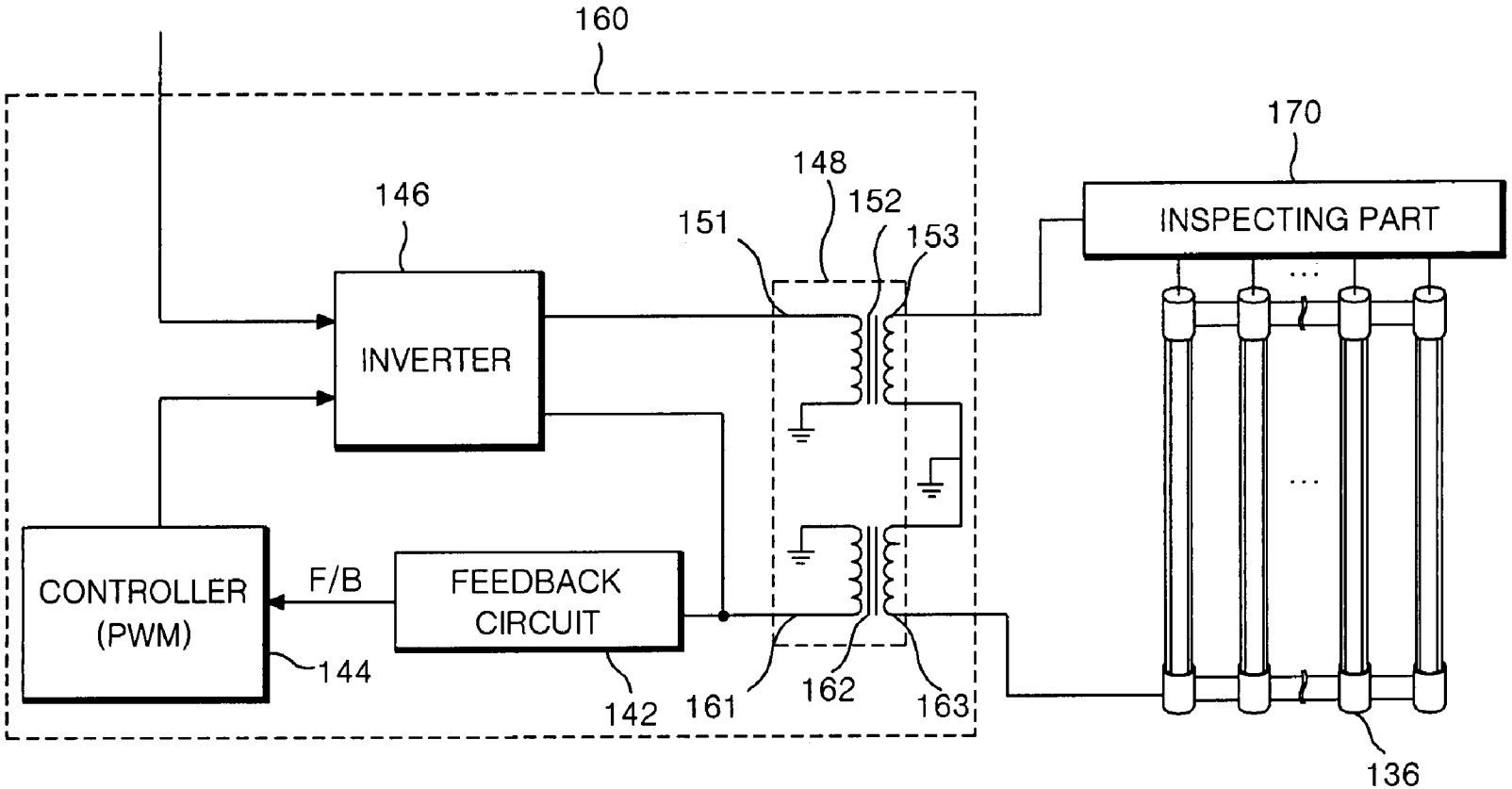
FIG. 4 is a block diagram illustrating a lamp driver of a liquid crystal display device according to an embodiment of the present invention.

Referring to FIG. 4, an apparatus for driving a lamp of a liquid crystal display device according to an embodiment of the present invention includes: a plurality of lamps 136 to generate light; an inverter 146 to receive a DC voltage from an external voltage source (not shown) and to convert it into an AC signal and to supply the AC signal to the lamps 136; a transformer 148 to boost the AC signal generated from the inverter 146; a feedback circuit 142 to detect a tube current flowing in the lamps 136; a controller 144 to control the inverter 146 in accordance with the feedback signal F/B generated from the feedback circuit 142; and an inspecting part 170 arranged between the lamps 136 and the feedback circuit 142 to inspect each lamp 136.

Each of the lamps 136 includes a glass tube, an inert gas in the inside of the glass tube, and a cathode and an anode installed at both ends of the glass tube. The inside of the glass tube is charged with the inert gas, and the phosphorus is spread over the inner wall of the glass tube. Further, the cathode and the anode of each lamp 36 are integrated in the same polarity. In each of the lamps 136, if the AC voltage of high voltage supplied from the inverter circuit 146 and the transformer 148 is applied to a high voltage electrode and a low voltage electrode, then an electron is emitted from the low voltage electrode to collide with the inert gas inside the glass tube, thereby increasing the amount of electrons by geometric progression. The increased electrons cause electric current to flow in the inside of the glass tube, thereby exciting the inert gas by the electron to emit ultraviolet radiation. At this time, the AC waveform of the high voltage is continually supplied to the lamps 136, so that the lamps 136 are continually turned-on.

The inverters 146 receive a DC voltage from an external voltage source and use a switch device included in the inverter circuit 146, to thereby convert the DC voltage into an AC signal Each of the transformers 148 is induced to an Ac voltage generated to a primary winding 151, 161 by switching of the switch device included in the primary windings 151, 161, an auxiliary winding 152, 162, and the inverter circuit 146, to include a secondary winding 153, 163 generating an AC high voltage and the auxiliary windings 152, 162 arranged between the primary windings 151, 161 and the secondary windings 153, 163. These transformers 148 boost the AC signal generated from the inverter 146 to supply it to the lamps 136.

The feedback circuit 142 detects the AC high voltage, generated from the inverter 146 to be supplied to the lamps 136, to generate a feedback signal F/B. If the feedback circuit 142 is located at the output terminal of the lamp 136, the feedback circuit 142 detects the output value outputted from the lamp 136.

The controller 144 receives the feedback signal F/B generated from the feedback circuit 146 to control the switch device included in the inverter circuit 146. More specifically, if the feedback signal F/B is higher than a predetermined reference voltage, then the controller 144 makes the switch device transmit a voltage lower than the reference voltage. In other words, a voltage amount is lowered, so that a current flowing in the lamp 136 is lowered. On the other hand, if the feedback signal F/B is lower than the predetermined reference, then the controller 144 makes the switch device transmit a voltage higher than the reference voltage. In other words, a voltage amount becomes higher, so that a current flowing in the lamp 136 becomes higher.

Figure 5:
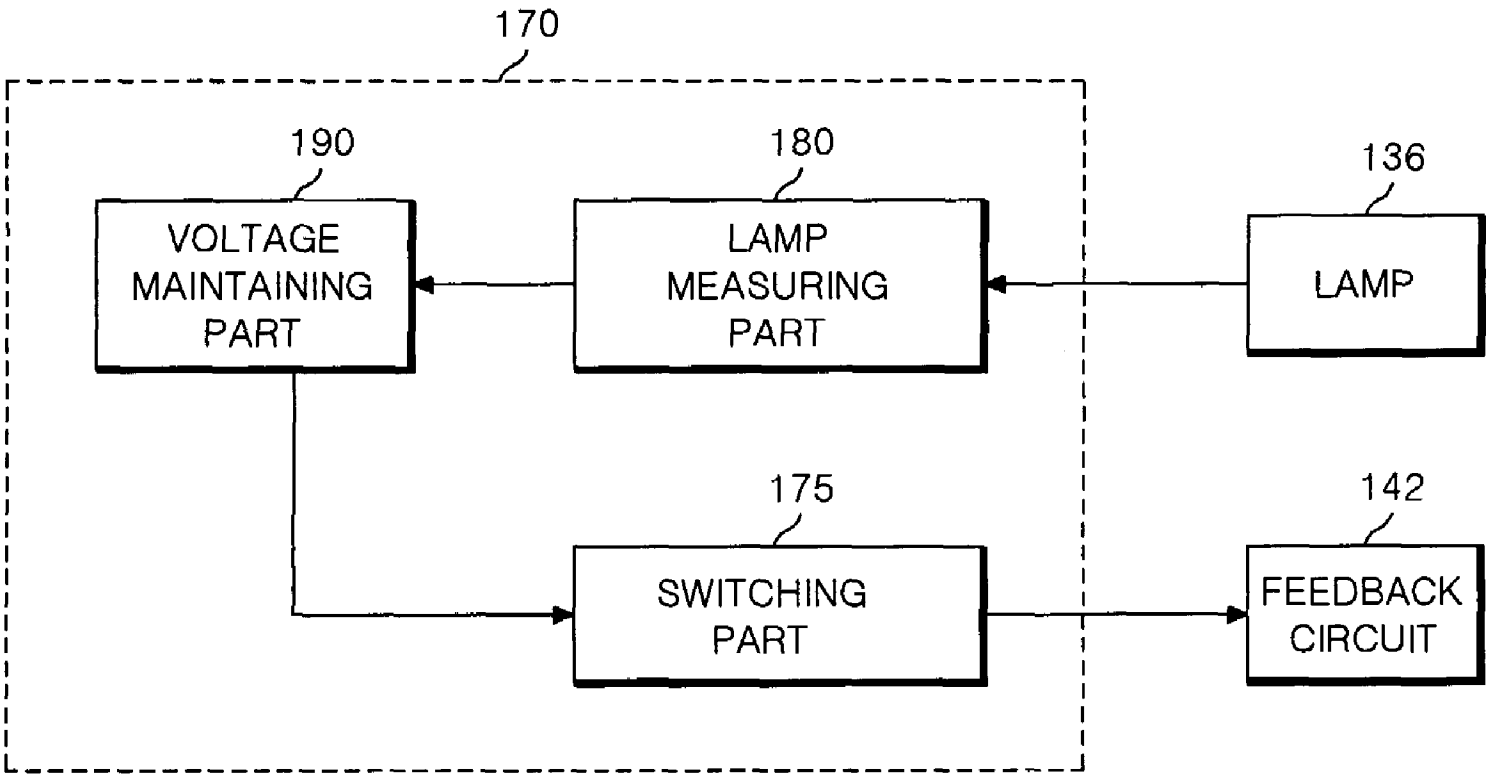
FIG. 5 is a block diagram illustrating an inspecting part in FIG. 4.

The inspecting part 170, as shown in FIG. 5, includes: a lamp measuring part 180 connected to each lamp 136; a voltage maintaining part 190 connected to the lamp measuring part 180; and a switching part 175 connected to the voltage maintaining part 190.

Figure 6:
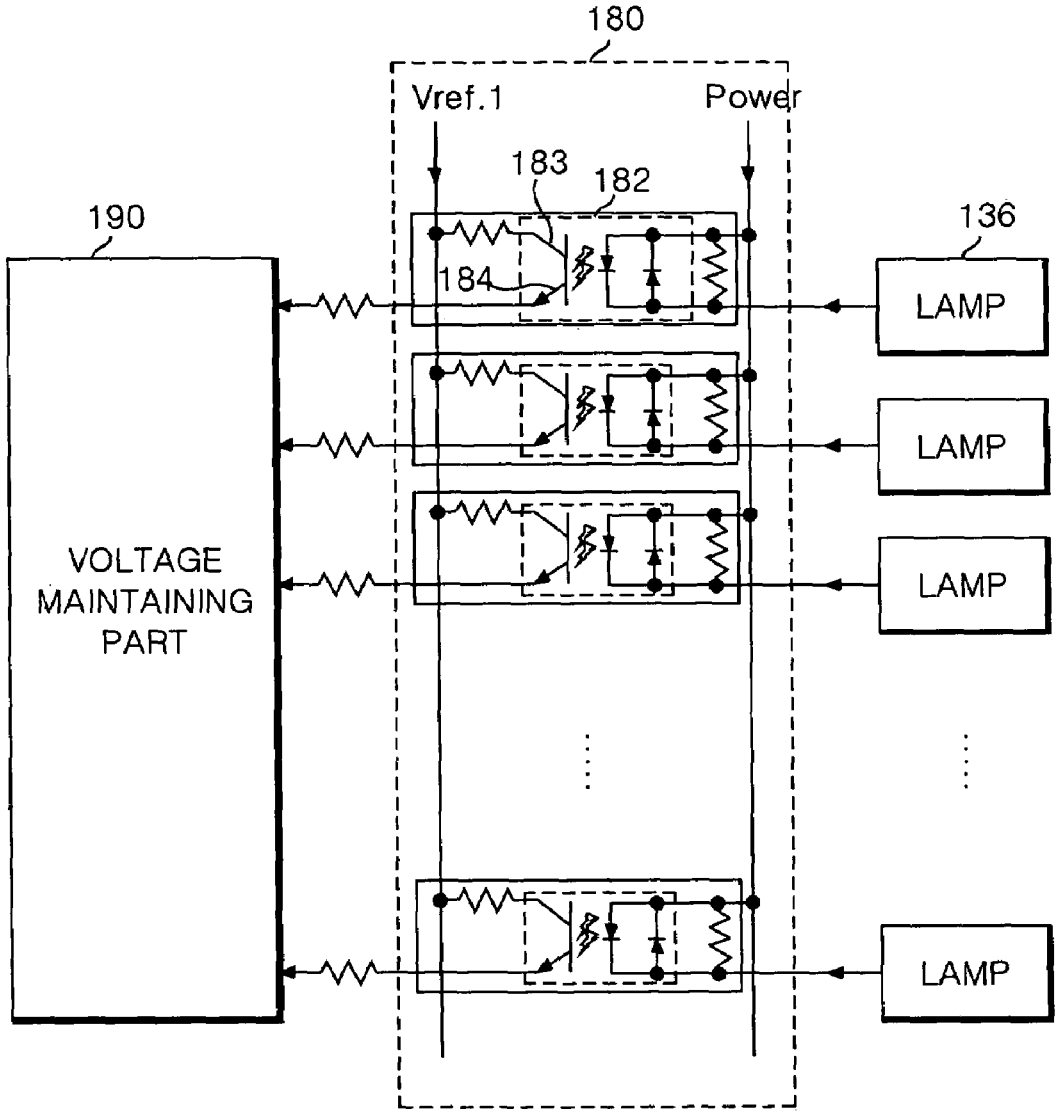
FIG. 6 is a block diagram illustrating a lamp measuring part in FIG. 5.

The lamp measuring part 180 is a control device that receives a signal outputted from the lamp 136 and uses an opto-coupler, that is, a device for generating light, as a first switch device, to thereby control a power supply. Herein, since the voltage and the current generated from the lamp 136 are high, the high voltage and the high current generated from the lamp 136 are not directly applied to the inspecting part 170. Accordingly, the opto-coupler is used generate signals in the inspecting part 180. With reference to FIG. 6, when a power supply is supplied to the lamp 136, the opto-coupler 182 connected to the lamp 136 generates light and the generated light permits switch terminals 183 and 184 of the opto-coupler 182 to be connected to each other. A first reference voltage source Vref.1, e.g. 5v, is connected to a collector terminal 183 of the opto-coupler 182, so that the first reference voltage Vref.1 is connected to the voltage maintaining part 190 via an emitter terminal 184 if the opto-coupler 182 is activated.

Figure 7:
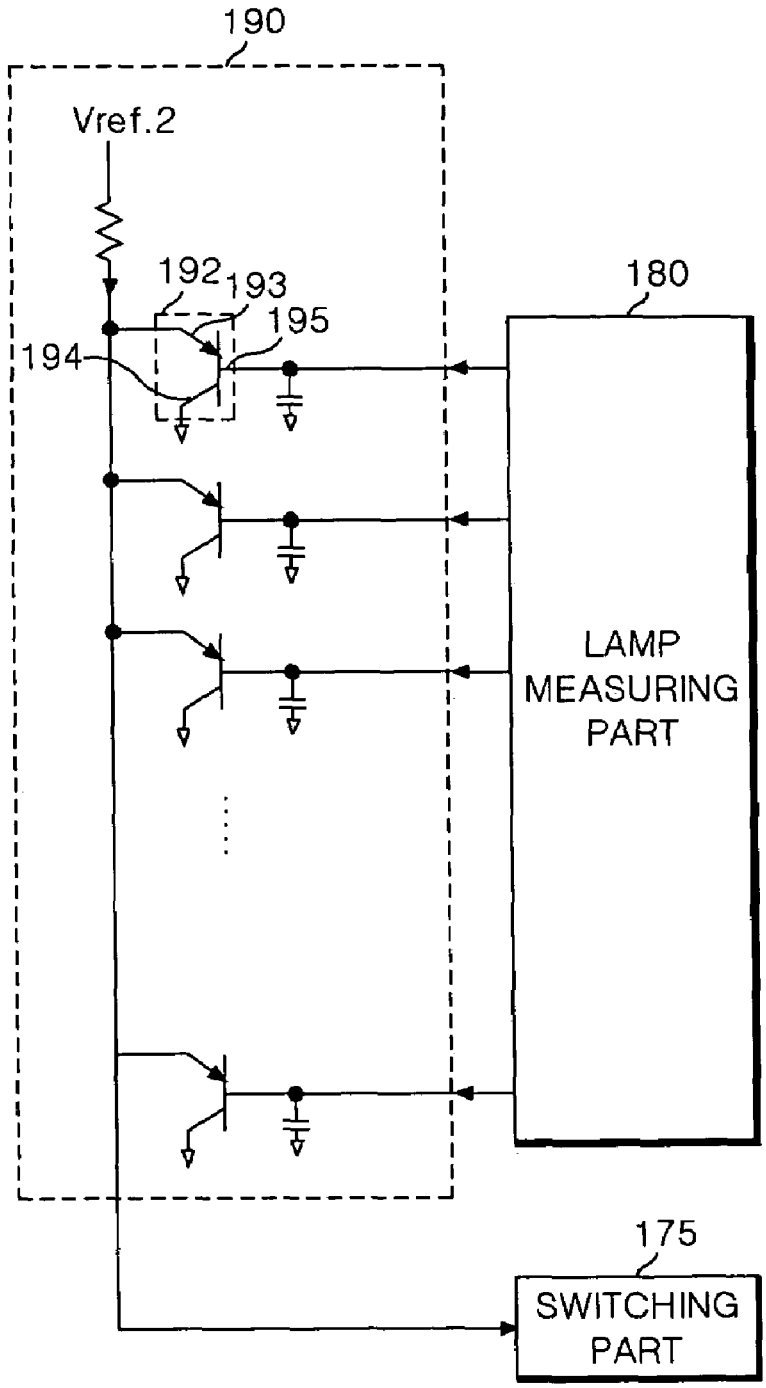
FIG. 7 is a block diagram illustrating a voltage maintaining part in FIG. 5.

The voltage maintaining part 190 is reciprocally connected to a voltage transmitted from the lamp measuring part 180 by use of a PNP type transistor as a second switch device 192, to thereby control a second reference voltage Vref.2. With reference to FIG. 7, the emitter terminal 193 of the second switch device 192 is connected to the second reference voltage source Vref.2, e.g. 5 v. A base terminal 195 is connected to the emitter terminal 184 of the opto-coupler 182 to receive the first reference voltage Vref.1 connected to the opto-coupler 182 in accordance with a condition of the lamp 136. The collector terminal 194 of the second switch device 192 is grounded.

Figure 8:
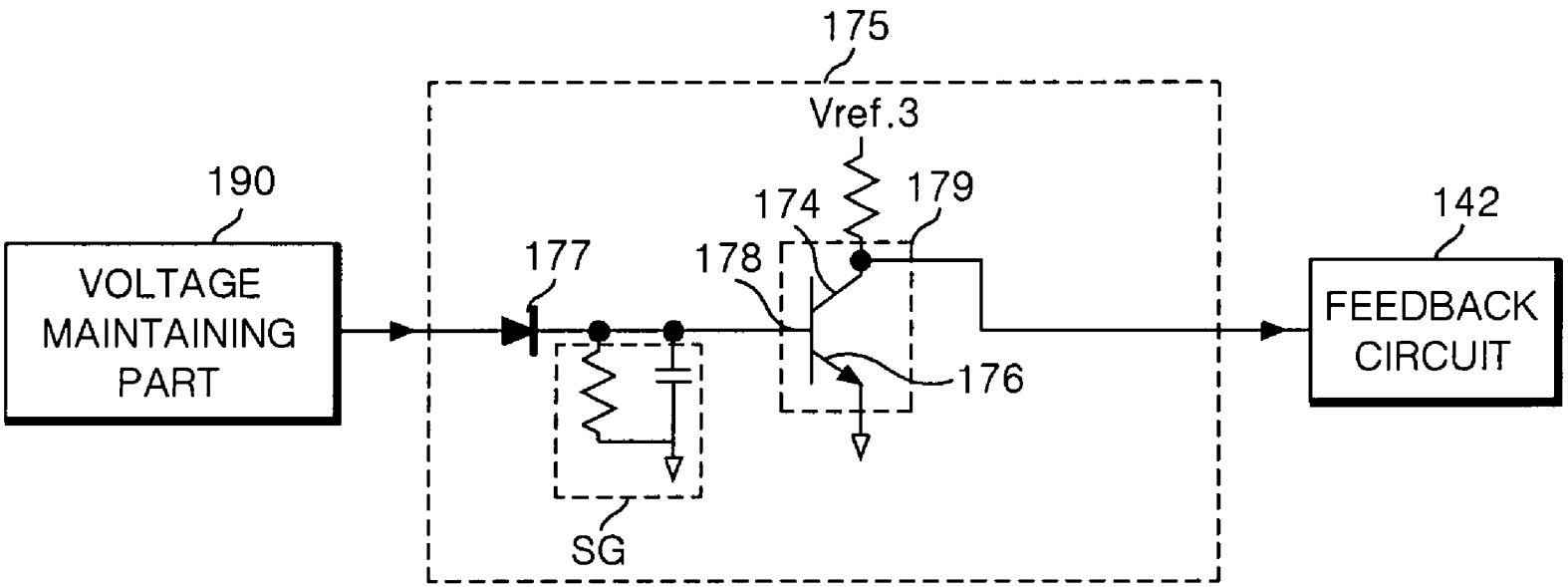
FIG. 8 is a circuit diagram showing a switching part in FIG. 5.

Referring to FIG. 8, the switching part 175 supplies a voltage, generated from a third reference voltage source Vref.3 connected to the switching part 175, to the feedback circuit 142 in accordance with the voltage applied from the voltage maintaining part 190. The switching part 175 includes a diode 177 arranged between the voltage maintaining part 190 and the feedback circuit 142 and a third switch device 179, that is a NPN type transistor, arranged between the diode 177 and the third reference voltage source Vref.3. An input terminal of the third reference voltage source Vref.3 and the feedback circuit 142 is connected to a collector terminal 174 of the third switch device 179, and an emitter terminal 176 of the third switch device 179 is grounded. An output terminal of the voltage maintaining part 190 is connected to a base terminal 178 of the third switch device 179. Herein, a signal ground SG is connected in parallel between the diode 177 and the switch device 179, to remove signal noise.

A performing process of the inspecting part having the above structure will be described as follows.

First of all, if light of the lamp is not generated due to a bad connection or a breakdown of a specific lamp among the lamps 136, then the opto-coupler 182 is not activated because the opto-coupler 182 of the lamp measuring part 180 is a NPN type transistor. Accordingly, the first reference voltage Vref.1 is not supplied to the voltage maintaining part 190.

Next, if the first reference voltage Vref.1 is not supplied to the base terminal 195 of the second switch device 192, then the second switch device 192 is turned on and the second reference voltage Vref.2 is grounded to a ground terminal via the collector terminal 194 because the second device 192 of the voltage maintaining part 190 is a PNP type.

Finally, the third switch device of the switching part 175 does not receive the second reference voltage Vref.2 from the voltage maintaining part 190, as the second reference voltage Vref.2 is grounded, thereby interrupting a path between the emitter 176 and collector 174. Accordingly, no current flows in the third switch device 179 and thus the third reference voltage Vref.3 is supplied to the feedback circuit 142. The feedback circuit 142 supplied with the third reference voltage Vref.3 passes through the controller 144 to shut down the inverter 146.

Each switch device in the inspecting part 170 can be an NPN type or the PNP type transistor. When the opto-coupler 182 is replaced by a PNP transistor, the second switch device 192 in the voltage maintaining part 190 is replaced by a NPN type transistor, to thereby have the same effect. By the same technique, when the switch device type of the voltage maintaining part 190 is changed, the switch device type included in the switching part 175 is changed, to thereby have the same effect.

As described above, the apparatus for driving the lamp of the liquid crystal display device according to the embodiment of the present invention uses the current generated from the lamps and the opto-coupler to thereby decrease the power supply applied to the lamps when an abnormity exists in one of the lamps. Accordingly, a load amount generated in the lamps that are turned on remains the same even through one of the lamps is turned off. Thus, it is possible to protect the lamps.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A lamp driving apparatus of a display device, the apparatus comprising:

a plurality of lamps to irradiate light to a display panel;

an inverter receiving a DC voltage from an exterior voltage source to convert the DC voltage into an AC signal and to supply the converted AC signal to the lamps;

a feedback circuit arranged between the inverter and the lamps to detect a current outputted from the lamps; and an inspecting part disposed between the feedback circuit and the lamps, the inspecting part comprising a light emitting device to determine if one of the lamps has an abnormality, wherein the inspecting part comprises:

a lamp measuring part connected between the one of the lamps and the feedback circuit;

a voltage maintaining part connected between the lamp measuring part and the feedback circuit; and a switching part arranged between the voltage maintaining part and the feedback circuit.

2. The apparatus according to claim 1, wherein the light emitting device comprises an opto-coupler that generates light using a power supply to be switched-on or switched-off in accordance with the generated light.

3. The apparatus according to claim 2, wherein the lamp measuring part detects the current outputted from the one of the lamps in which a collector terminal of the opto-coupler is connected to a first reference voltage, an emitter terminal of the opto-coupler is connected to the voltage maintaining part, and a base terminal of the opto-coupler is connected to the one of the lamps.

4. The apparatus according to claim 2, wherein a first reference voltage connected to the opto-coupler, a second reference voltage connected to a switch device in the voltage maintaining part, and a third reference voltage connected to a switch device in the switching part, are formed in a range of 2V to 10V.

5. The apparatus according to claim 1, wherein the voltage maintaining part includes a second switch device in which an emitter terminal is connected to a second reference voltage, a collector terminal is connected to a ground terminal, and a base terminal is connected an output terminal of the lamp measuring part.

6. The apparatus according to claim 5, wherein a first reference voltage connected to the opto-coupler, the second reference voltage, and a third reference voltage connected to a switch device in the switching part, are formed in a range of 2V to 10V.

7. The apparatus according to claim 1, wherein the switching part includes a third switch device in which a collector terminal is connected to a third reference voltage and the feedback circuit, a base terminal is connected an output terminal of the voltage maintaining part, and an emitter terminal is connected to a ground terminal.

8. The apparatus according to claim 7, further comprising a signal ground part arranged in parallel between the voltage maintaining part and the third switch device to remove signal noise flowing from the voltage maintaining part to the third switch device.

9. The apparatus according to claim 7, wherein a first reference voltage connected to the opto-coupler, the second reference voltage, and the third reference voltage, are formed in a range of 2V to 10V.

10. A lamp driving apparatus of a display device, the apparatus comprising:

a plurality of lamps that irradiates a display panel with light;

a feedback circuit that adjusts a voltage supplied to the lamps dependent on a feedback signal from the lamps; and a determination circuit comprising an optical transmitter-receiver pair for each of the lamps in which each optical transmitter-receiver pair reacts differently when the associated lamp has an abnormality than when the associated lamp is operating normally and adjusts the feedback signal dependent on output signals from the optical transmitter-receiver pairs, wherein the determination circuit comprises:

a lamp measuring circuit connected between the lamps and the feedback circuit;

a voltage maintaining circuit connected between the lamp measuring circuit and the feedback circuit; and a switching circuit arranged between the voltage maintaining circuit and the feedback circuit.

11. The apparatus according to claim 10, wherein the lamp measuring circuit detects a current from each of the lamps, the lamp measuring circuit comprising the optical transmitter-receiver pairs.

12. The apparatus according to claim 11, wherein the voltage maintaining circuit comprises a plurality of switches that adjust an output signal from the voltage maintaining circuit depending on the output signals from the optical receivers.

13. The apparatus according to claim 12, wherein the switching circuit comprises a switch that adjusts the feedback signal dependent on the output signal from the voltage maintaining circuit.

14. The apparatus according to claim 13, wherein the switches in the voltage maintaining circuit are disposed in parallel such that the output signal from the voltage maintaining circuit to the switching circuit is a single signal.

15. The apparatus according to claim 14, wherein the output signal from the voltage maintaining circuit is grounded when at least one of the lamps has an abnormality.

16. The apparatus according to claim 13, further comprising a noise reduction circuit that decreases noise from the output signal of the voltage maintaining circuit prior to the output signal being supplied to the switch in the switching circuit.

17. The apparatus according to claim 10, wherein each switch in the voltage maintaining circuit is connected to one optical receiver in the lamp measuring circuit.

18. The apparatus according to claim 10, wherein the optical transmitter transmits light to the optical receiver when the associated lamp is operating normally and does not transmit light to the receiver when the associated lamp has an abnormality.

* * * * *